US005810658A

United States Patent [19]

Seo

[11] Patent Number: 5,810,658

[45] Date of Patent: Sep. 22, 1998

[54] INTERLOCKING DEVICE FOR CLOSING OR OPENING THE SUCTION AND EXHAUST PORTS IN AIR CONDITIONERS

[75] Inventor: Jeong-Hun Seo, Seoul, Rep. of Korea

[73] Assignee: Samsung Electronics Co., Ltd., Suwon, Rep. of Korea

[21] Appl. No.: 727,231

[22] Filed: Oct. 8, 1996

[30] Foreign Application Priority Data

Nov. 30, 1995 [KR] Rep. of Korea ..... 95-37672
Nov. 30, 1995 [KR] Rep. of Korea ..... 95-45792

[51] Int. Cl.[6] ..... F24F 13/12

[52] U.S. Cl. ..... 454/233; 454/324

[58] Field of Search ..... 454/233, 234, 454/309, 313, 321, 324, 334, 370; 62/262, 404

[56] References Cited

U.S. PATENT DOCUMENTS 3,691,929 9/1972 Huling, Jr. ..... 454/234
5,435,781 7/1995 Kitchens ..... 454/324 X

FOREIGN PATENT DOCUMENTS 63-32242 2/1988 Japan ..... 454/233
63-286650 11/1988 Japan ..... 454/233

*Primary Examiner*—Harold Joyce
*Attorney, Agent, or Firm*—Burns, Doane, Swecker & Mathis, L.L.P.

[57] ABSTRACT

An air conditioner includes a housing forming a lower air suction port and an upper air exhaust port, which ports are opened and closed simultaneously by a mechanism which includes first and second shutters movable vertically in parallel planes. The shutters carry respective rack gears which mesh with opposite sides of a motor-driven pinion gear, whereby the shutters move simultaneously in opposite directions.

4 Claims, 5 Drawing Sheets

INTERLOCKING DEVICE FOR CLOSING OR OPENING THE SUCTION AND EXHAUST PORTS IN AIR CONDITIONERS

BACKGROUND OF THE INVENTION

1. Field of the Invention

The present invention relates, in general, to a device for selectively closing or opening the suction and exhaust ports in air conditioners.

2. Description of the Prior Art

FIGS. 1 to 3 show the construction of a typical air conditioner. As shown in the drawings, the typical air conditioner has a holder panel 3, which is vertically installed in the front section inside the housing 1. A reversible motor 5 is mounted to the holder panel 3 and is connected to a power supply (not shown) so that electric power is applied to the motor 5. A pinion gear 7 is fixed to the output shaft 6 of the above motor 5 and is rotated in opposite directions by the rotational force of the reversible motor 5. The pinion gear 7 meshes with into a vertical rack gear 9, which converts the reversible rotating motion of the pinion gear 7 into a vertical linear reciprocating motion. A shutter 13 is mounted to the rack gear 9 in order to selectively close the exhaust port 11 in accordance with a vertical movement of the rack gear 9. Installed in the lower section of the housing 1 is a room air suction grille 14, which has a plurality of suction ports 14*a* and introduces room air into the housing 1.

Two types of movable cold air exhaust grilles 15 and 17, which control the exhaust direction of cold air in the vertical and horizontal directions respectively, are set in the upper section of the holder panel 3. Room air is sucked into the housing 1 through the suction ports 14*a* of the suction grille 14 and is cooled by the evaporator of the air conditioner prior to being discharged into the room through the exhaust port 11. When the cold air is discharged into the room, the flow direction of the cold air is controlled by the exhaust grilles 15 and 17. Each side of the above holder panel 3 is provided with a guide rail (not shown), which movably engages with the shutter 13 in order to guide the shutter 13 while the shutter 13 vertically reciprocates.

In FIGS. 1 to 3, the reference numeral 19 denotes the front panel of the housing 1, which protects the interior parts such as the evaporator of the air conditioner. The numeral 21 denotes a control panel, which controls the operation of the air conditioner.

When the air conditioner is not used, the exhaust port 11 is closed by operating an associated button of the control panel 21. When the button of the control panel 21 is operated in order to close the exhaust port 11, electric power of the power source is applied to the motor 5 so that the motor 5 is turned on and is rotated in the normal direction. The normal rotating force of the motor 5 is output through the output shaft 6 so that the pinion gear 7 of the shaft 6 is rotated in the normal direction. The rotating force of the motor 5 in turn is transmitted to the rack gear 9 thus lifting the rack gear 9 in the vertical direction. The shutter 13, which is mounted to the rack gear 9, moves upward and closes the exhaust port 11. The shutter 13 thus prevents introduction of foreign substances such as dust into the housing 1 through the exhaust port 11 while the air conditioner is not used.

Meanwhile, when the air conditioner is used, the control panel's button corresponding to the exhaust port 11 is operated in order to open the port 11. The motor 5 is thus rotated in the reverse direction so that the pinion gear 7 of the shaft 6 is rotated in the reverse direction by the reverse rotating force of the motor 5. The rotating force of the motor 5 in turn is transmitted to the rack gear 9 thus lowering the rack gear 9 along with the shutter 13. The shutter 13 thus opens the exhaust port 11. In the above state, room air is sucked into the housing 1 through the suction ports 14*a* of the suction grille 14 and is cooled by the evaporator prior to being discharged into the room through the exhaust port 11. The direction of the discharged cold air in the above state is controlled by the exhaust grilles 15 and 17.

However, the above air conditioner has the following problems. That is, the suction ports 14*a* of the suction grille 14 are small-sized ports so that the suction ports 14*a* may fail to smoothly suck room air into the housing 1 thereby reducing the operational effect of the air conditioner. The small-sized suction ports 14*a* also regrettably cause operational noises while room air passes through the ports 14*a*. Another problem of the above air conditioner resides in that foreign substances such as dust may be introduced into the housing 1 through the suction ports 14*a* when the air conditioner is not used.

SUMMARY OF THE INVENTION

It is, therefore, an object of the present invention to provide an interlocking device for closing or opening the exhaust and suction ports in air conditioners in which the above problems can be overcome and which has exhaust and suction port shutters and interlocks the shutters together in order to cause the above shutters to cooperate with each other when closing or opening the exhaust and suction ports, and which effectively prevents introduction of foreign substances such as dust into the air conditioners when the air conditioners are not used, and enlarges the amount of inlet air of the air conditioners.

In order to accomplish the above object, the present invention provides an interlocking device, which is installed inside the housing of an air conditioner and automatically closes or opens the air exhaust and suction ports of the air conditioner in a way such that the ports are closed or opened at the same time.

In the preferred embodiment of this invention. The interlocking device includes a first shutter provided in an upper section inside the air conditioner's housing and adapted for selectively closing the exhaust port, a second shutter provided in a lower section inside the air conditioner's housing and adapted for selectively closing the suction port, and drive means mounted to the holder panel of the exhaust port and adapted for interlocking the first and second shutters together and driving the shutters at the same time in order to close or open the exhaust and suction ports.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
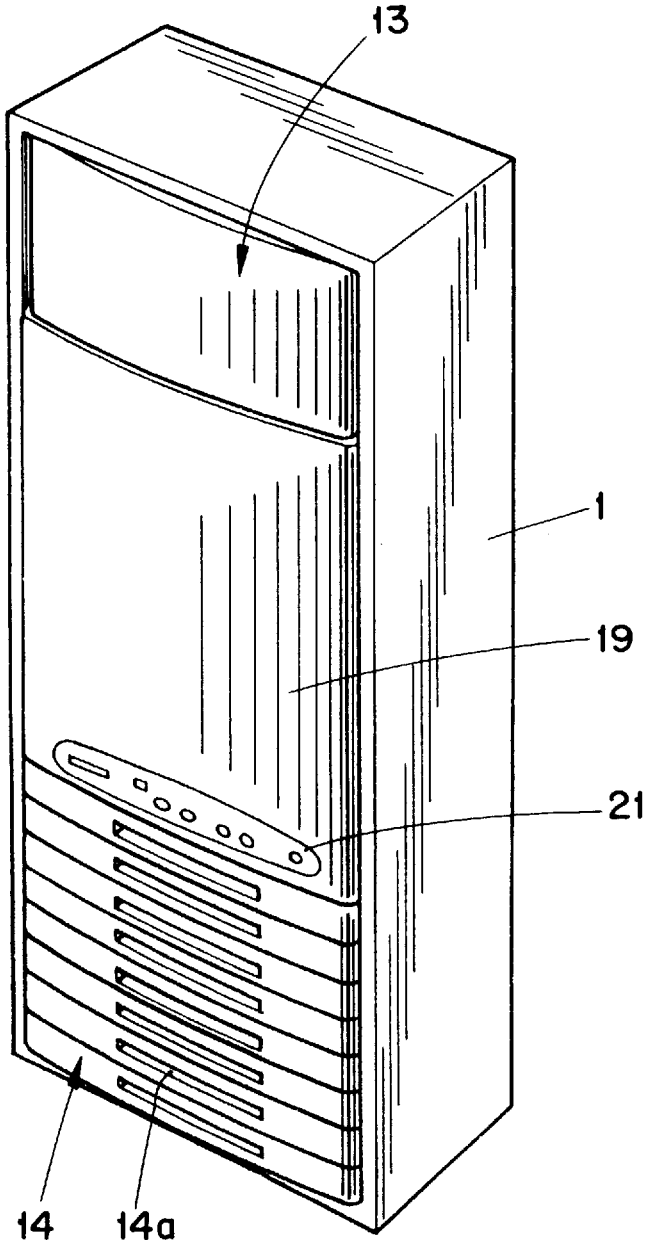
FIG. 1 (PRIOR ART)
FIG. 1 is a perspective view showing the configuration of a typical air conditioner.
Figure 2:
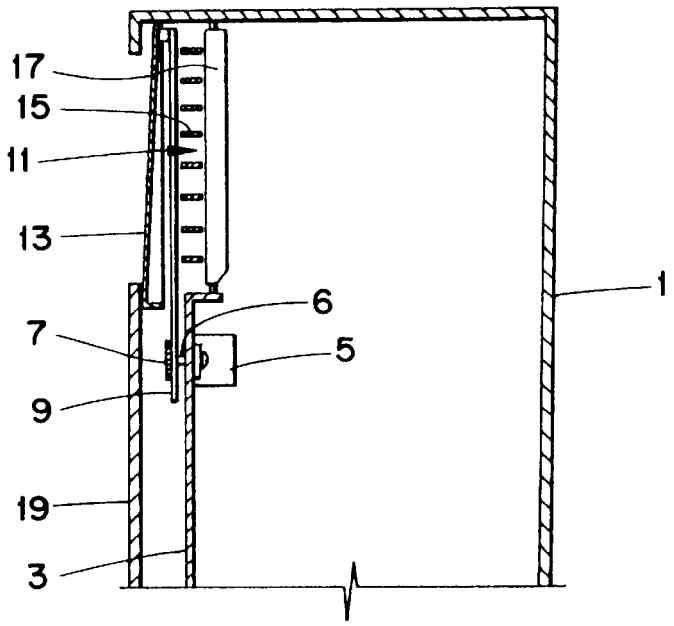
FIG. 2 (PRIOR ART)
FIG. 2 is a sectional view of the typical air conditioner with the shutter closing the exhaust port.
Figure 3:
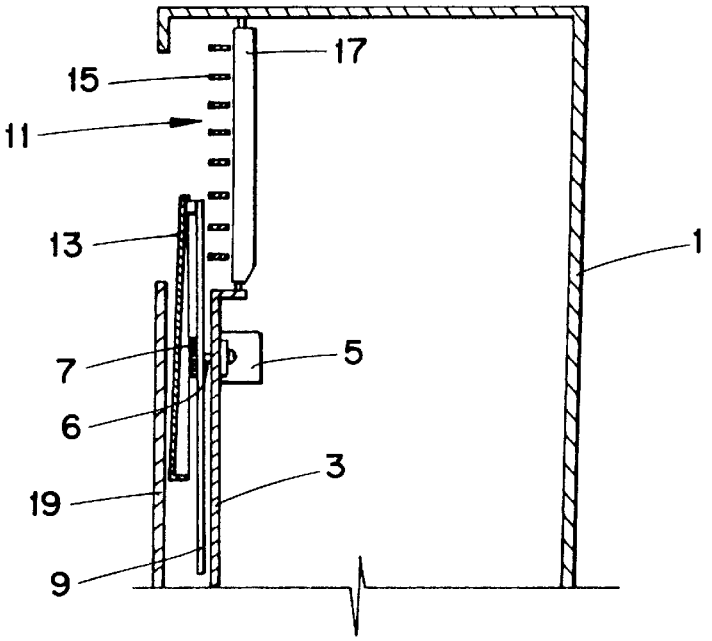
FIG. 3 (PRIOR ART)
FIG. 3 is a sectional view of the typical air conditioner with the shutter opening the exhaust port.
Figure 4:
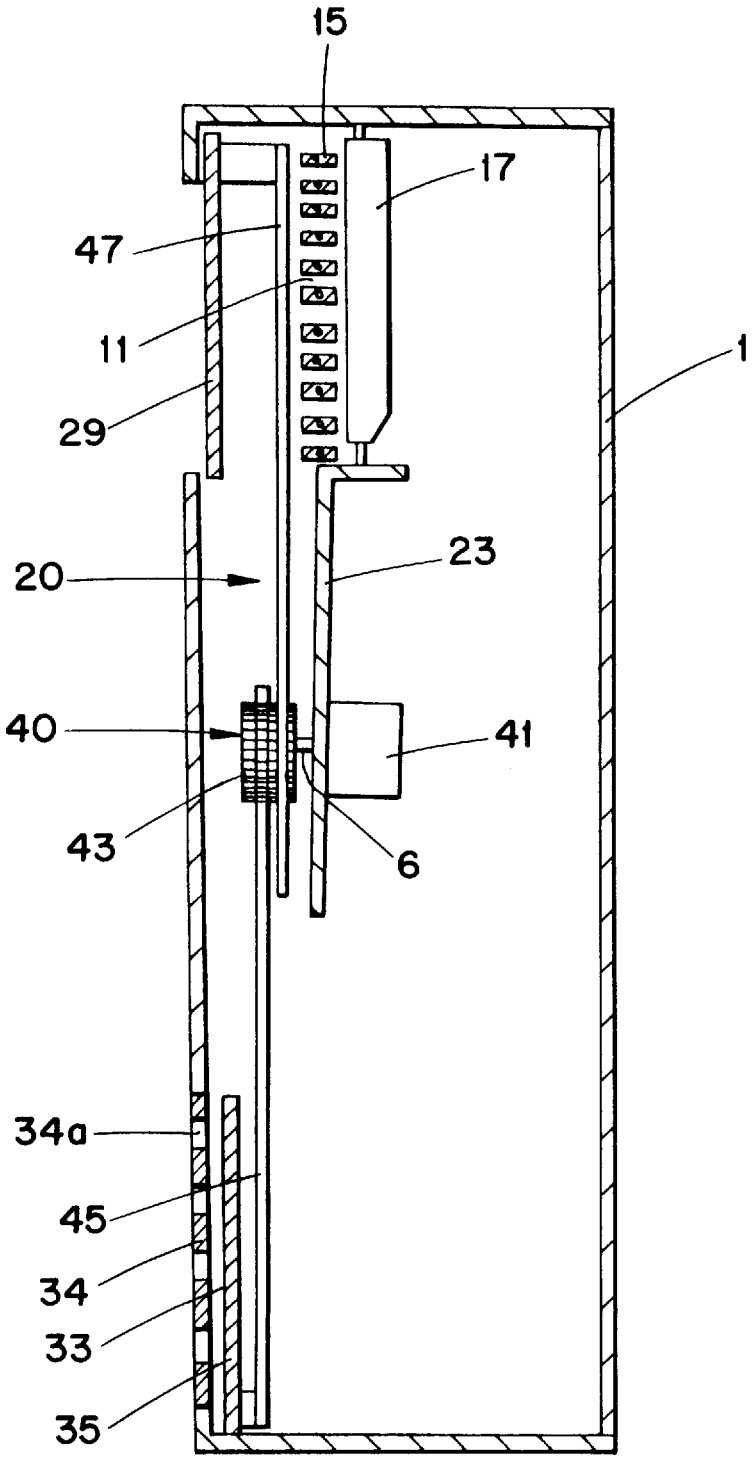
FIG. 4 is a side sectional view of the air conditioner with the interlocking device in accordance with the preferred embodiment of the present invention.
Figure 5:
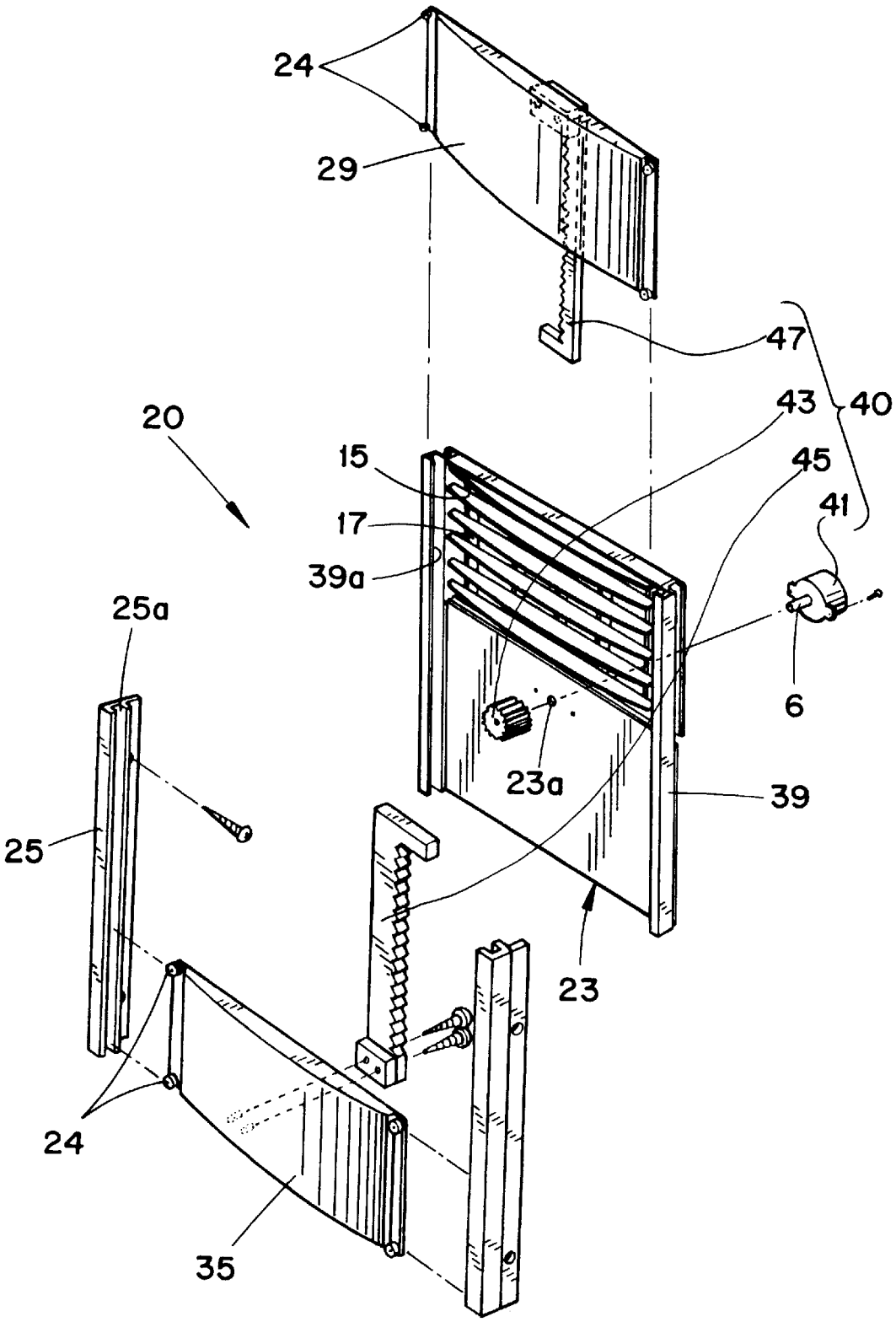
FIG. 5 is an exploded perspective view of the interlocking device of this invention.
Figure 6:
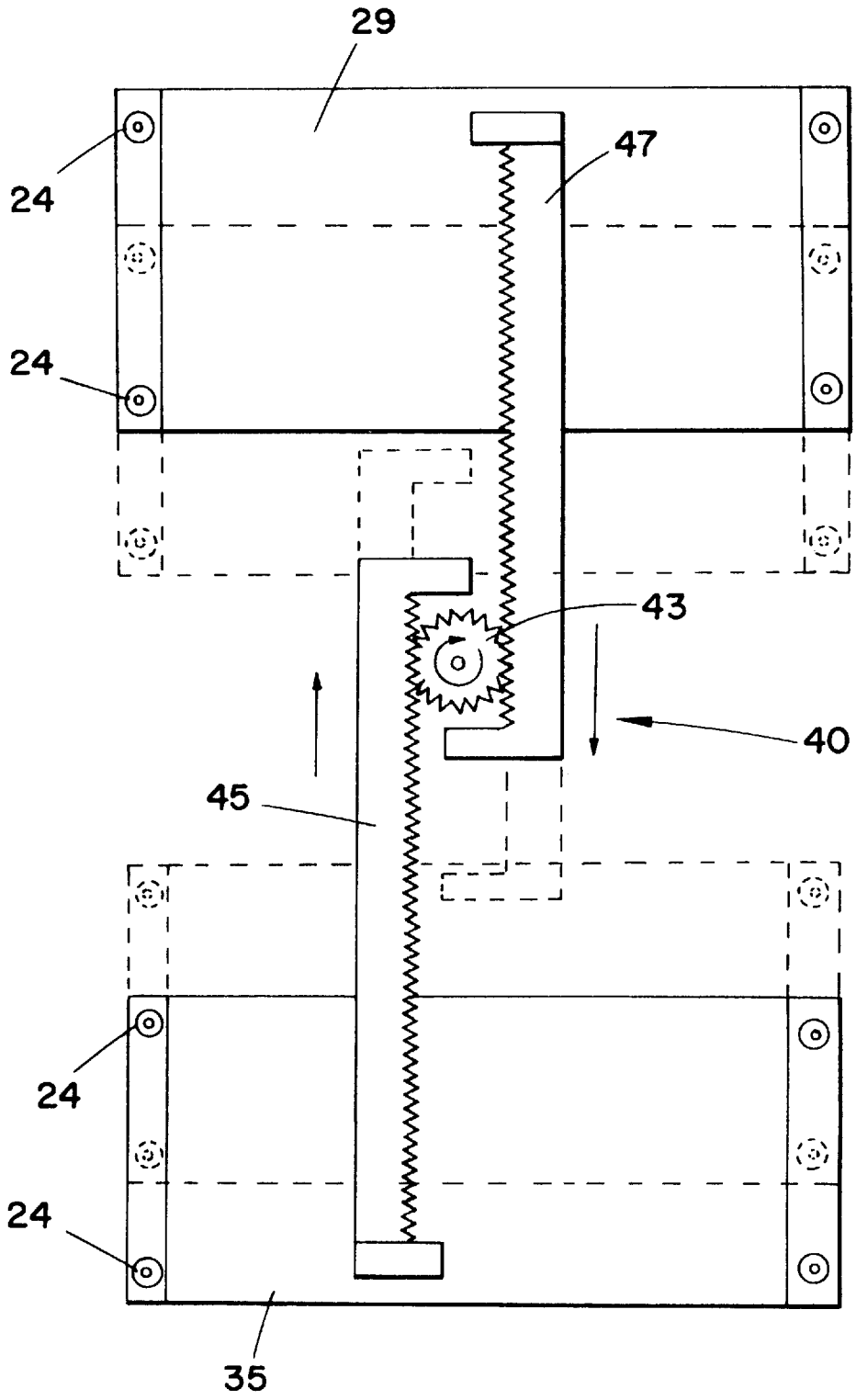
FIG. 6 is a view showing the operation of the interlocking device of this invention.

FIGS. 4 to 6 show the interlocking device for closing or opening the suction and exhaust ports in air conditioners according to the preferred embodiment of this invention. In the present invention, the general shape of the air conditioner remains the same as in the typical air conditioner. Those elements of the air conditioner common to both the present invention and the prior art will thus carry the same reference numerals and further explanation is not deemed necessary.

The interlocking device 20 of this invention is installed in the front section inside the housing 1 of an air conditioner as shown in FIG. 4. The above device 20 automatically closes or opens the exhaust and suction ports 11 and 34*a* of the air conditioner at the same time. The above ports 11 and 34*a* are formed in the upper and lower sections of the housing 1, respectively.

As shown in FIGS. 4 and 5, the interlocking device 20 includes two shutters, that is, first and second shutters 29 and 35. The first shutter 29 is provided in the upper section inside the housing 1 and selectively closes the exhaust port 11 so that it may be referred to as "exhaust port shutter". Meanwhile, the second shutter 35 is provided in the lower section inside the housing 1 and selectively closes the suction port 34*a* so that it may be referred to as "suction port shutter". The interlocking device 20 also includes a drive means 40, which is mounted to the holder panel 23 of the exhaust grilles 15 and 17 and interlocks the shutters 29 and 35 together and drives both shutters 29 and 35 in order to automatically close or open the exhaust and suction ports 11 and 34*a* at the same time. In accordance with the present invention, the size of the suction port 34*a* of the suction grille 34 is enlarged in comparison with the suction port 14*a* of the typical air conditioner so that the suction port 34*a* increases the amount of inlet air of the air conditioner.

In the interlocking device 20, the drive means includes a reversible motor 41, which is mounted to one surface of the holder panel 23. A pinion gear 43 is fixed to the output shaft 6 of the reversible motor 41 at a position on the other surface of the holder panel 23. The pinion gear 43 is thus rotated by the rotating force of the motor 41. The drive means also includes first and second vertical rack gears 47 and 45, which mesh with the pinion gear 43 at diametrically opposite positions of the pinion gear 43 so that the rack gears 47 and 45 linearly reciprocate in opposite vertical directions by the rotational force of the motor 41, thus closing or opening the first and second shutters 29 and 35, respectively. The holder panel 23 has a through hole 23*a*, which receives the output shaft 6 of the motor 41. Two types of movable cold air exhaust grilles 15 and 17, which form the exhaust port 11 and control the exhaust direction of cold air in the vertical and horizontal directions respectively, are set in the upper section of the above holder panel 23. A first guide rail 39 is mounted to each side edge of the holder panel 23 and movably engages with a respective side edge of the first shutter 29 so that the first shutter 29 vertically reciprocates under the guidance of the first guide rails 39. The first guide rails 39 are provided with respective longitudinal guide grooves 39*a* engaging with both side edges of the first shutter 29.

In addition, second guide rails 25 are installed in the lower section inside the air conditioner's housing 1 and movably engages with respective side edge of the second shutter 35 so that the second shutter 35 vertically reciprocates under the guidance of the second guide rails 25. The above second guide rails 25 are provided with respective longitudinal guide grooves 25*a* engaging with both side edges of the second shutter 35.

In each of the shutters 29 and 35, rollers 24 are mounted at the corners so that the shutters 29 and 35 smoothly reciprocate in the vertical direction under the guidance of the respective guide rails 39 and 25.

The operational effect of the above interlocking device will be described hereinbelow.

When the air conditioner is not used, the exhaust and suction ports 11 and 34*a* are closed by operating an associated button of the control panel. When the button of the control panel is operated in order to close the exhaust and suction ports 11 and 34*a*, electric power of the power source is applied to the motor 41 so that the motor 41 is turned on and is rotated counterclockwise in FIG. 5. The rotating force of the motor 41 in the above state is output through the output shaft 6 so that the pinion gear 43 is rotated counterclockwise. Therefore, the first and second rack gears 47 and 45 vertically move in opposite directions. That is, the first rack gear 47 along with the first shutter 29 is lifted up, while the second rack gear 45 along with the second shutter 35 comes down. In the above state, the shutters 29 and 35 smoothly slide along the respective guide rails 39 and 25 due to the rollers 24.

The first and second shutters 29 and 35 thus close the exhaust and suction ports 11 and 34*a* of the air conditioner at the same time and prevent the introduction of foreign substances such as dust into the housing through the ports 11 and 34*a*.

Meanwhile, when the air conditioner is used, the control panel's button corresponding to the exhaust and suction ports 11 and 34*a* are operated in order to rotate the motor 41 clockwise. Therefore, the pinion gear 43 of the shaft 6 is rotated clockwise so that the first rack gear 47 along with the first shutter 29 comes down, while the second rack gear 45 along with the second shutter 35 is lifted up. The first and second shutters 29 and 35 open the exhaust and suction ports 11 and 34*a* of the air conditioner at the same time.

In the above state, room air is sucked into the housing 1 through the suction ports 34*a* of the suction grille 34 and is cooled by the evaporator of the air conditioner prior to being discharged into the room through the exhaust port 11. During the operation of the air conditioner, the size of the suction port 34*a* of the suction grille 34 is enlarged in comparison with the suction port 14*a* of the typical air conditioner so that the amount of inlet air of the air conditioner is increased, thus improving the operational efficiency of the air conditioner. The large-sized suction port 34*a* also preferably reduces the operational noises of the air conditioner.

As described above, the present invention provides an interlocking device for closing or opening the exhaust and suction ports in air conditioners. The interlocking device has exhaust and suction port shutters and interlocks the shutters together in order to cause the shutters to cooperate with each other when closing or opening the exhaust and suction ports. The above device thus effectively prevents the introduction of foreign substances such as dust into the air conditioners when the air conditioners are not used. In the present invention, the amount of inlet air of the air conditioner is increased due to the enlarged suction port so that the operational efficiency of the air conditioner is improved.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising a housing forming an air suction port and an air exhaust port; and a motor-driven mechanism disposed in the housing for opening or closing both of the air suction and exhaust ports simultaneously, the mechanism comprising first and second shutters mounted in the housing for vertical movement to upper and lower sections, respectively, of the housing for closing respective ones of the suction and exhaust ports, and a drive device interlocking the first and second shutters for common movement in opposite directions; the drive device comprising a reversible motor supported by the housing, a pinion gear fixed to an output shaft of the motor, and first and second rack gears fixed to the first and second shutters respectively, the rack gears meshing with diametrically opposite sides of the pinion gear to be driven vertically simultaneously in opposite directions by the motor.

2. The air conditioner according to claim 1, further including guides for guiding respective vertical edges of the first and second shutters during vertical movement thereof.

3. The air conditioner according to claim 2 wherein the guides comprise guide rails each having a vertical guide groove for slidably receiving an edge of a respective shutter.

4. The air conditioner according to claim 1 wherein the air suction and exhaust ports are disposed in a front panel of the housing, the first and second shutters being movable in respective vertical planes oriented parallel to one another, one of the planes being situated closer to the front panel than is the other plane.

* * * * *